US006026659A

United States Patent [19]

Kaping, Jr.

[11] Patent Number: 6,026,659

[45] Date of Patent: Feb. 22, 2000

[54] BODY JEWELRY DEVICE AND METHOD OF MAKING THE SAME

[76] Inventor: Dennis John Kaping, Jr., 9983 Paseo Montril, San Diego, Calif. 92129

[21] Appl. No.: 09/177,308

[22] Filed: Oct. 22, 1998

[51] Int. Cl.[7] ..... A44C 7/00

[52] U.S. Cl. ..... 63/12; 63/29.1

[58] Field of Search ..... 63/12, 29.1; 482/106, 482/107, 108; 411/366.1, 371.1, 389, 399; 606/185, 188

[56] References Cited

U.S. PATENT DOCUMENTS

| | | | |
|---|---|---|---|
| 256,015 | 4/1882 | Lubin | 24/105 |
| 466,276 | 12/1891 | Le Garde | 482/108 |
| 1,160,723 | 11/1915 | Lander | 63/29.1 |
| 2,053,918 | 9/1936 | Peretzman | 411/371.1 |
| 3,488,051 | 1/1970 | Papistas-Scherer | 482/108 |
| 3,504,507 | 4/1970 | Ferro | 63/12 |
| 3,945,089 | 3/1976 | Gagnon | 63/12 X |
| 4,076,236 | 2/1978 | Ionel | 482/108 |
| 4,299,101 | 11/1981 | Block | 63/12 |
| 4,353,225 | 10/1982 | Rogers | 63/13 |
| 4,720,098 | 1/1988 | Gordon | 482/108 |
| 4,973,043 | 11/1990 | Nolan | 482/45 |
| 5,379,909 | 1/1995 | Roark | 482/108 X |

FOREIGN PATENT DOCUMENTS

| | | | |
|---|---|---|---|
| 2274237 | 7/1994 | United Kingdom | 63/12 |

*Primary Examiner*—Brian K. Green
*Assistant Examiner*—Andrea Chop
*Attorney, Agent, or Firm*—Higgs Fletcher & Mack LLP; Bernard L. Kleinke

[57] ABSTRACT

The body jewelry device has a post part and cap part with the cap part having an integral and threaded stub. The post part has an integrally formed and complementary threaded bore for receiving the threaded stud. The cap part post is thereby securely, but releasably, coupled to the post part. In a preferred embodiment, the cap has a counter sink for receiving an end of the post. The cap for the body jewelry may be formed by shaping a stock material into a generally enlarged ornamental piece. A stub is integrally formed on the generally enlarged shape and threads formed on the stub. A counter sink may be formed around the stub for receiving an end of the post. The stub threads are constructed to threadably mate with an opposing and complementary bore on a post.

11 Claims, 2 Drawing Sheets

BODY JEWELRY DEVICE AND METHOD OF MAKING THE SAME

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Technical Field

The field of the present invention relates to body jewelry and methods for making the same. More particularly, this invention relates to body jewelry which may be extended through a passageway that has been pierced in a body.

2. Background Art

For centuries, adorning the human body with jewelry has been an important aspect of celebration and self-expression. In one aspect of displaying body jewelry a piercing instrument is used to create a passageway in a body part. A post is extended through the passageway and caps positioned on the ends of the post, with the caps acting to retain the post within the passageway of the body part. For example, a person may pierce a passageway through one or both earlobes. An appropriately ornamented earring is selected with a post extending from the earring. The length of the post is selected to extend through the passageway sufficiently so that a backing clip is positionable over the post. The backing clip typically slides over the post and frictionally couples to the post, thereby retaining the post in the passageway and positioning the earring for display.

However, body jewelry may be positioned on other body parts. For example, eyebrows, lips, nose bridges, or belly buttons or other body parts may be pierced and various ornamental body jewelry positioned in the pierced passageway.

It is common for the body jewelry to be retained in the passageway by a larger cap that is frictionally retained to the post. For example, U.S. Pat. No. D394,412 shows a body jewelry having a post that may extend through a passageway. An ornamental ball acts as a cap to retain the post in the passageway. The cap appears to be held in place by compression forces applied by the post. Thus, the cap is frictionally coupled to the post.

In the body piercing art it is considered particularly exotic to pierce a passageway in the tongue and display body jewelry extending through the passageway. A popular body jewelry for display on a pierced tongue consists of a post with enlarged caps. The post is sized to extend through the passageway with the caps attaching to each end of the post. This post with two enlarged caps is conveniently identified as a "bar bell stud."

In known bar bell stud devices, a peg couples each cap to an end of a post. One end of the peg is attached to the cap or post and the other end removably couples the cap to the post. The peg is frictionally attached to the cap or post. To assist the friction fit, an adhesive or plastic insert may be used to increase the retention of the peg into the cap or post. The removably coupled end of the peg may have threads or a frictional slip-fit for retaining the cap to the post as in the earring discussed above. In use, the post is inserted through the passageway in the tongue and the caps coupled to the post. Thereby the caps are retained on the post.

However, body jewelry positioned on the tongue will be subjected to the same environmental conditions as the wearer's mouth. Therefore, the jewelry will be subjected to the searing heats of hot foods such as coffee and soups and to the freezing colds of frozen foods such as shakes and ice cream. Such temperature extremes cause thermal expansion and contraction of the body jewelry device. Since the peg is attached frictionally to either the cap or the post or both, the thermal expansion acts to loosen the cap from the post. Further, the expansion and contraction effects are worsened if the peg is constructed from a material that is different from the post or cap. Even if the peg is held in place with additional adhesives or plastics, the peg will eventually loosen as the coefficients of expansion will be different between the cap or post material and the plastic or adhesive.

When the peg loosens and the cap works free from the post, the cap will be released into the wearer's mouth cavity where it may damage teeth or be swallowed. Further, the post and the other cap still may slip from the passageway in the tongue and likewise cause dental or gastronomic problems. Additionally, once the post is removed from the passageway, the tongue immediately begins healing the passageway and within a short period will prevent any post from being inserted through the passageway. Later, if another body jewelry is to be inserted in the same passageway, the person may be subjected to the discomfort and risk of an additional tongue piercing session.

Another type of bar bell stud is known in the art. In this type of bar bell stud a post has threads extending from each end. Caps, having integrally recessed threads, mate with the post threads. To use this type of bar bell stud, a cap is secured to one end of the post, the post inserted through the passageway in the tongue, and the second cap secured to the post threads. However, the post has exposed threads. These exposed threads contact the interior of the passageway as the post is thrust through the tongue. Such contact may not only be painful for the wearer, but may tear or inflame the tender tissue in the passageway.

Therefore, there exists a need for a body jewelry that is more securely positioned on a body part, without causing irritation on insertion through the body part.

SUMMARY OF THE INVENTION

It is desirable to have a body jewelry for use with a body part that avoids the risks of loosening due to thermal expansion. Further, it is desirable to have a body jewelry device that may be inserted comfortably through a body part and retained long term in the body part.

It is therefore an object of the present invention to provide a body piercing jewelry that is comfortably positionable through a pierced passageway in a body part and retainable in the body part with minimal risk of loosening. It is another object of the present invention to have a body piercing jewelry that is retainable in a pierced passageway for an extended period of time.

To overcome the disadvantage in the prior art and meet the objectives of this invention, a body jewelry device and method for making the same is herein disclosed and claimed.

The body jewelry device has a post part and cap part with the cap part having an integral and threaded stub. The post part has an integrally formed and complementary threaded bore for receiving the threaded stud. The cap part post is thereby securely, but releasably, coupled to the post part. In a preferred embodiment, the cap has a counter sink for receiving an end of the post. The cap for the body jewelry may be formed by shaping a stock material into a generally enlarged ornamental piece. A stub is integrally formed on the generally enlarged shape and threads formed on the stub. A counter sink may be formed around the stub for receiving an end of the post. The stub threads are constructed to threadably mate with an opposing and complementary bore on a post.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings. The drawings identified below are not necessarily drawn to scale, and selected features may be enlarged to assist understanding.

BEST MODE FOR CARRYING OUT THE INVENTION

Figure 1:
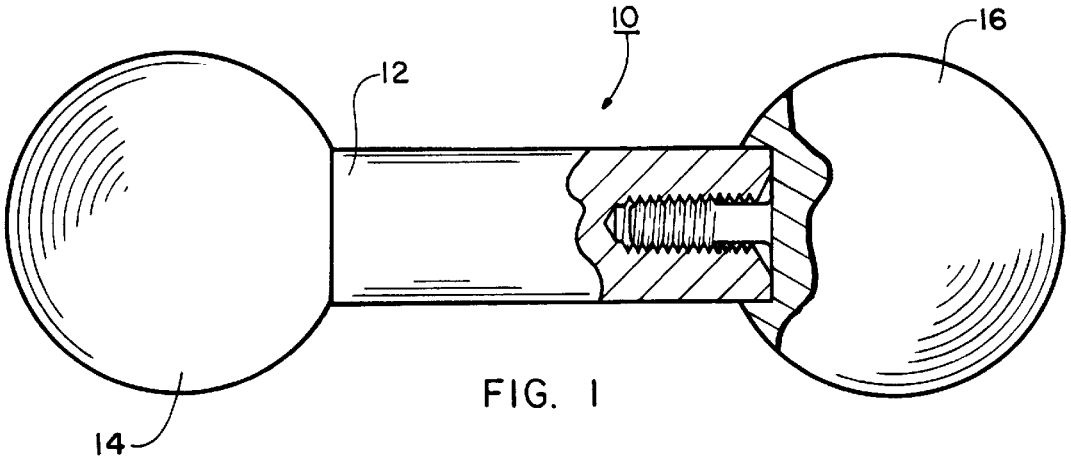
FIG. 1 shows a front view and partial cross section of a bar bell stud constructed in accordance with the present invention.

Referring to FIG. 1, a bar bell stud 10 made in accordance with the present invention is shown. The bar bell stud 10 comprises a post 12 with cap 14 coupled to one end of the post 12, and cap 16 coupled to the other end of the post 12.

In use the post 12 extends through a pierced passageway in a wearer's tongue. The cap 14 threadably attaches to one end of the post 12. The other cap 16 threadably couples to the other end of the post 12. The post 12 is sized with a cross section sufficient to allow its insertion through the pierced passageway in the tongue. Further, the post 12 has a length sufficient to allow the caps 14 and 16 to be threaded thereupon with the post positioned in the passageway. The caps 14 and 16 are sized to resist passing through the passageway pierced in the tongue. Thereby when the post is inserted through the passageway in the tongue and the caps attached to the post, the bar bell stud 10 is securely held on the tongue.

Figure 2:
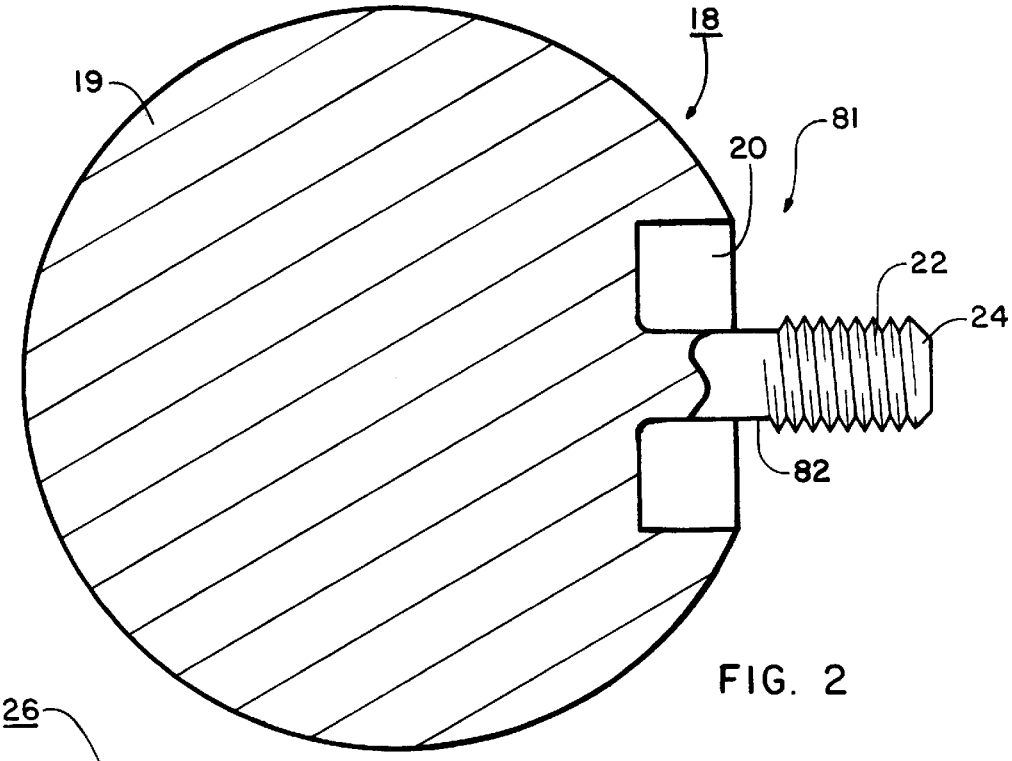
FIG. 2 is a partial cross-sectional diagram of a cap made in accordance with the present invention.
Figure 3:
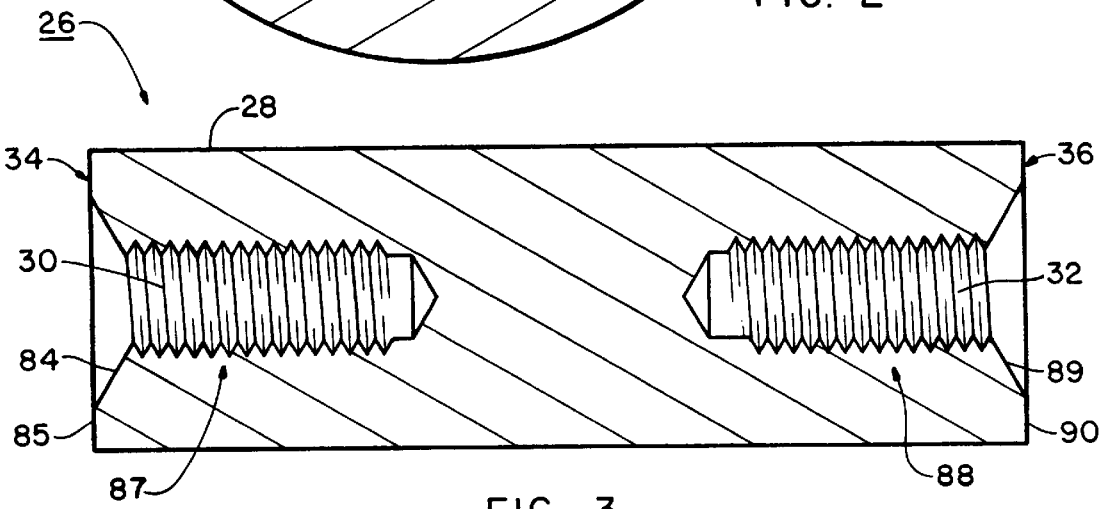
FIG. 3 is a cross-sectional view of a post made in accordance with the present invention.

FIG. 2 shows the partial cross section of a cap 18 made in accordance with the present invention. The cap 18 has an enlarged area in the shape of a sphere 19 with a stub 81 integrally formed in the cap 18. As shown in FIG. 3, the post 26 has a bore 87 in one end 34 and a bore 88 in the other end 36. The bores 87 and 88 are of a complementary shape to the stub 81. In use the stub 81 is received by the bore 87 or the bore 88.

Referring again to FIG. 2 the cap 18 will be discussed in more detail. The cap 18 is formed in a generally spherical shape 19 with an integrally formed stub 81 extending therefrom. The stub 81 comprises an unthreaded base portion 82, and a threaded portion 22. Further, the threaded portion 22 has a tapered end 24. The stub 81 extends generally axially from the spherical shape 19. A counter sink 20 is positioned about the stub 81. The counter sink 20 is sized to accept an annular end (85 or 90) of the post 26 (FIG. 3). Although the cap 18 is shown as a generally spherical shape, those skilled in the art will recognize that other shapes may be used consistent with the present invention.

Referring now to both FIGS. 2 and 3, the post 26 may be a generally cylindrical member 28 with a bore 87 in one end 34 and a bore 88 in the other end 36. The bore 87 comprises a threaded portion 30 and an entrance taper 84. In a like manner, bore 88 comprises a threaded portion 32 and an entrance taper 89. The threaded portion 22 of the cap 18 is constructed to be complementary to and threadably received by the threaded portion 30 or 32. Although the post 26 is shown as a cylindrical member, those skilled in the art will recognize that other shapes may be used consistent with the inventive disclosure. The tapered end 24 and the tapered entrances make insertion of the threaded portion 22 into the threaded portion (30 or 32) easier.

The coupling of the cap 18 to the post 26 will now be detailed. As discussed above, the threaded portion 22 is constructed to be threadably received by the threaded portion 30. As the cap 18 is rotated with the threaded portion 22 received into the threaded portion 30, the annular end 85 is drawn into the counter sink 20. As the cap 18 is tightened, the annular end 85 may bottom with the counter sink 20.

The cap 18 is thereby removably coupled to the post 26. Although the coupling of the cap 18 to the post 26 has been described for end 34, it is understood that the cap 18 may couple with the end 36. In such a manner, the stub 81 is received into the bore 88 and the annular shoulder 90 may bottom into the counter sink 20. By having the post counter sink into the cap, the intersection between the cap and the post is made particularly aesthetically pleasing.

The cap 18 and post 26 are preferably constructed of the same material. By constructing the cap 18 and the post 26 from the same material the post and cap will have like thermal expansion properties and loosening caused by thermal expansion will be minimized. Further, since the threaded stub is integrally formed in bores of the cap and the receiving threads are integrally formed in the post 26, there are no surfaces which are only frictionally retained. By eliminating all frictionally retained parts, the risk of loosening due to thermal expansion has been greatly minimized.

The cap 18 and post 26 may be made of any material where threads of sufficient strength may be formed. Preferably, the cap 18 and the post 26 are constructed from a stainless steel and most preferably a surgical stainless steel. Alternatively, titanium, gold, and "Lucite plastic material have been found to be acceptable materials. However, those skilled in the art will recognize other materials exist consistent with the inventive disclosure.

Figure 4A:
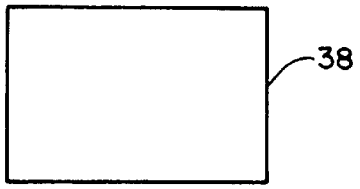
FIGS. 4*a*–4*d* show a process for constructing a cap for body jewelry in accordance with the present invention.
Figure 4B:
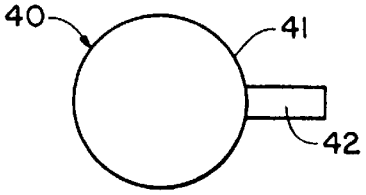

FIGS. 4*a*–4*d* show a process of constructing a cap for a bar bell stud body jewelry. FIG. 4*a* shows a stock rod 38 of a selected material. As discussed above, this selected material may be surgical stainless steel or another appropriate material. The stock rod 38 is shaped into an intermediate cap 40 as shown in FIG. 4*b*. The intermediate cap 40 has a generally enlarged portion 41 and a stub portion 42 extending therefrom. In FIG. 4*b* the generally enlarged portion 41 is a substantially spherical shape with the stub portion 42 axially extending from the enlarged portion. Those skilled in the art will recognize other shapes may be substituted for the spherical shape.

Figure 4C:
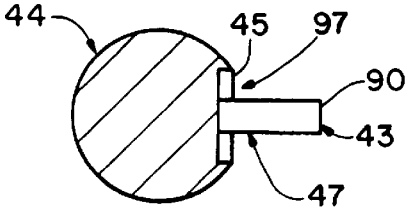
Figure 4D:
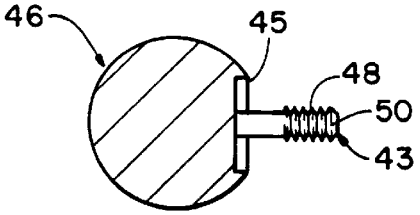

FIG. 4*c* shows a cross section of an intermediate cap 44 where additional material has been removed from the intermediate cap 44 so that the stub portion 43 now comprises a base portion 47 and a threadable portion 90. Further, a counter sink 45 has been formed surrounding the stub portion 43. The counter sink 45 is sized to receive a post from a body jewelry. The counter sink 45 has been removed from a face 97 of the intermediate cap 44. FIG. 4*d* shows a cap 46 with the stub 43 having a threaded portion 48 and a tapered end 50.

Figure 5:
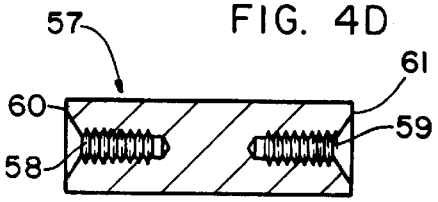
FIG. 5 is a cross-sectional view of a post for use with the present invention.

FIG. 5 shows a post 57 constructed for use with cap 46. The post 57 has an end 60 and an end 61. End 60 has a threaded bore 58 and end 61 has a threaded bore 59 with the threaded bores 58 and 59 constructed to threadably couple with the threaded portion 48. In use, the tapered end 50 is inserted into the threaded bore 58 or 59 and the cap 46 rotated to couple the threaded portion 48 to the threaded bore 58 or 59. As the cap 46 is threadably rotated toward the post 57, the cap 46 and the post 57 are drawn toward each other. The end 60 or 61 is received into the counter sink 45 and the cap part and the post part tightened until secure as previously described. By providing the counter sink 45, the intersection between the post 57 and the cap 46 is made more aesthetically pleasing. With one cap secured to the post 57, the post 57 may be inserted through a pierced passageway in the tongue. Since the post 57 has been sized with a cross section to extend through the tongue but the cap 46 is sized to resist traveling through the passageway, the cap 46 is retained on one side of the tongue. The post 57 is of a sufficient length to extend through the tongue and allow a second cap like cap 46 to be inserted and threadably coupled to the open end of the post 57. With both caps tightened and secured to the post 57, the post 57 is securely retained within the tongue.

Since the bar bell stud 10 has no parts which are only frictionally retained, the risk of a part loosening due to thermal expansion is greatly reduced. Further, any loosening due to thermal expansion is easily corrected by simply re-tightening the caps to the post.

Additionally, since the post has no external threads, only the smooth outer surface of the post contacts the internal tissue in the passageway. Thereby, the insertion of the post is done in a relatively comfortable manner as compared to prior art threaded posts. Further, the risk of tearing or inflaming the passageway tissue is reduced.

The processes shown in FIGS. 4*a*–4*d* is preferably performed by a machining process. With the machining process, the parts are milled and shaped with well-known shaping machines. Alternatively, the cap part and the post part may be molded to the appropriate shape. In this manner, either an injection molding process or another molding process may be used. Injection molding and other molding processes are also well-known in the arts. Those skilled in the art will recognize other forming processes may be used consistent with the disclosure herein.

Figure 6:
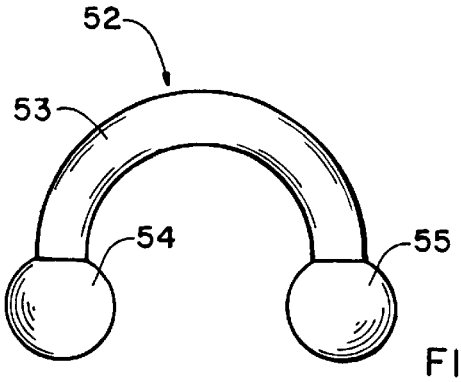
FIG. 6 is a front view of a bar bell stud made in accordance with the present invention.

FIG. 6 shows another body jewelry bar stud constructed in accordance with the present invention. The curved bar bell stud 52 has a c-shaped curved post, circular in cross section, and caps 54 and 55. The caps 54 and 55 are like cap 46. Curved post 53 is similar to post 57 except the post 53 extends in a curved configuration rather than a straight configuration as shown with post 57.

Although FIG. 6 shows a C-shaped curve on the post 53, those skilled in the art will recognize that curves of different styles can be used consistent with this inventive disclosure. Further, although the caps on FIG. 6 are shown as generally spherical those skilled in the art will recognize that other shapes are consistent with this inventive disclosure including other geometric shapes such as squares or diamonds or ornamental designs.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A body jewelry device adapted for insertion or removal into and out of a passageway in a body part, comprising:

a post member, the post member sized to have a cross-section and a length to extend through the body part passageway;

said post member having a uniform cross section throughout its length for comfortable insertion or removal into and out of the passageway;

said post member having an annular end, said end being flat throughout its entire surface;

at least one cap member, the cap member sized to resist passing through the body part passageway;

said at least one cap member being solid and constructed from machineable material;

a stub integral to the solid cap member, the stub having a distal threaded portion and an unthreaded base portion;

said cap member having a face and having a deep countersunk recess in the face for receiving said annular end;

a bore integral to the post member, the bore having a threaded portion, and the threaded stub portion and the threaded bore portion constructed to threadably couple;

said counter sunk recess being annular in shape and surrounding said unthreaded base portion;

said annular recess being uniform in cross section throughout its axial length for receiving the flat annular end of the post member bottomed there against to provide an aesthetically pleasing appearance; and wherein the post member can be retained in the body part passageway when the cap member is threadably coupled to the post member and the post member is removable from the body part passageway when the cap member is removed.

2. The body jewelry device according to claim 1 where the post member is a cylindrical rod.

3. The body jewelry device according to claim 1 where the post member is straight.

4. The body jewelry device according to claim 1 where the post member is curved.

5. The body jewelry device according to claim 1 where the cap member is substantially spherical.

6. The body jewelry device according to claim 1 where the post member has a second end and the cap member is threadably engageable to either end of the post member.

7. The body jewelry device according to claim 1 where the post is are constructed from a machineable material.

8. The body jewelry device according to claim 1 where the members are constructed of a material selected from the group consisting of stainless steel, titanium, gold, and plastic material.

9. A bar bell stud body jewelry device adapted for retention in a passageway pierced through a tongue, the bar bell stud device comprising:

two caps, with each cap having a generally enlarged portion and a cap face thereon;

each of said caps being solid and constructed from a machineable material;

an integral and threaded stub extending from each cap face, each stub having a distal threaded portion and an unthreaded base portion;

a deep annular counter sink on each cap face surrounding the stub;

a post, the post having two ends with each end further comprising a threaded bore that is complementary to the threaded stubs;

said post having a uniform cross section throughout its length for comfortable insertion or removal into and out of the passageway;

said post having an annular end, said annular end being flat throughout its entire surface;

said annular counter sink being uniform in cross section throughout its axial length for receiving the flat annular end of the post bottomed thereaaainst to provide an aesthetically pleasing appearance; and wherein one cap is threadably coupled to one end of the post, and the other cap threadably coupled to the other end of the post.

10. The bar bell stud device of claim 9 where the caps and post are constructed from the same material.

11. The bar bell stud device according to claim 10 where the material is one selected from the group consisting of surgical stainless steel, stainless steel, titanium, gold, and plastic material.

* * * * *

UNITED STATES PATENT AND TRADEMARK OFFICE

CERTIFICATE OF CORRECTION

PATENT NO. : 6,026,659
DATED : February 22, 2000
INVENTOR(S) : Dennis J. Kaping

It is certified that error appears in the above-identified patent and that said Letters Patent is hereby corrected as shown below:

Column 6,
Line 44, after "bottomed" should read -- thereagainst --
Line 60, change "a second end" to -- two --
Line 63, change "is are" to -- member is --

Column 8,
Line 6, change "thereaaainst" to -- thereagainst --
Line 6, after "provide" should read -- lateral structural strength and --

Signed and Sealed this

Twenty-fifth Day of December, 2001

*Attest:*

*Attesting Officer*

JAMES E. ROGAN
*Director of the United States Patent and Trademark Office*